United States Patent [19]

Bock et al.

[11] Patent Number: 4,461,696

[45] Date of Patent: Jul. 24, 1984

[54] SHALE-OIL RECOVERY PROCESS

[75] Inventors: Jan Bock, Bridgewater; Patrick P. McCall, Matawan; Max L. Robbins, South Orange; Michael Siskin, Livingston, all of N.J.

[73] Assignee: Exxon Research and Engineering Co., Florham Park, N.J.

[21] Appl. No.: 488,172

[22] Filed: Apr. 25, 1983

[51] Int. Cl.[3] ..... C10G 1/04

[52] U.S. Cl. ..... 208/11 LE; 208/8 LE; 208/11 R

[58] Field of Search ..... 208/11 LE, 8 LE, 11 R

[56] References Cited

U.S. PATENT DOCUMENTS

| | | | |
|---|---|---|---|
| 3,644,194 | 2/1972 | Kelly | 208/11 LE |
| 3,660,268 | 5/1972 | Kelly | 208/11 LE |
| 4,057,486 | 11/1977 | Medus et al. | 208/11 LE |

FOREIGN PATENT DOCUMENTS

| | | | |
|---|---|---|---|
| 297909 | 3/1930 | Canada | 208/11 LE |
| 792222 | 8/1968 | Canada | 208/11 LE |
| 171918 | 12/1921 | United Kingdom | 208/11 LE |

*Primary Examiner*—Delbert E. Gantz

*Attorney, Agent, or Firm*—Henry E. Naylor

[57] ABSTRACT

Disclosed is a process for converting organic material of oil-shale to predominantly liquids. The oil-shale is first heated to a temperature from about 360° C. to 475° C. in an inert atmosphere. The resulting liquids and gases are collected and the residue is extracted with a microemulsion capable of extracting organic material from the heat treated oil-shale.

15 Claims, 1 Drawing Figure

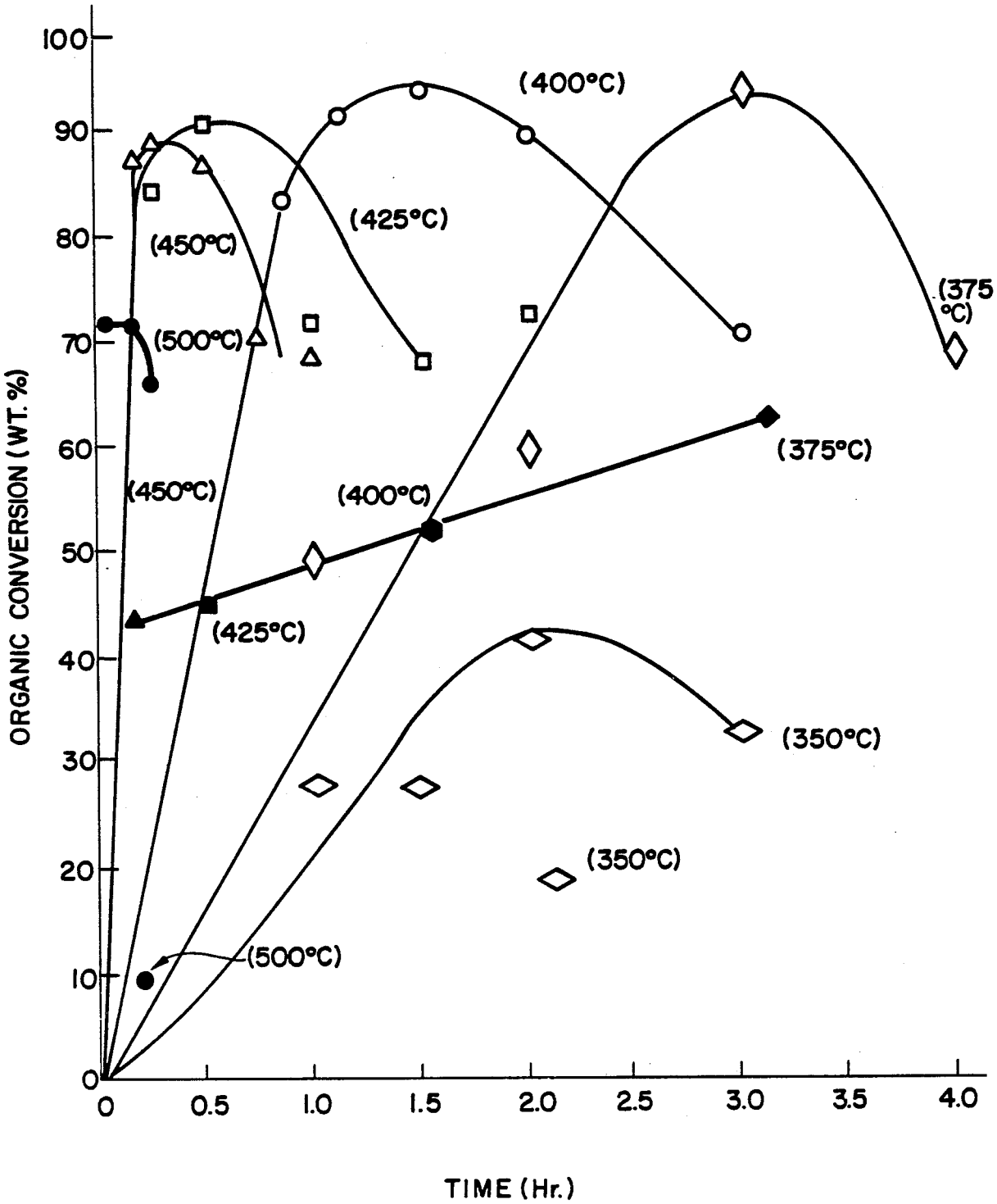
ORGANIC CONVERSION (WT.%)
TIME (Hr.)
0
10
20
30
40
50
60
70
80
90
100
0
0.5
1.0
1.5
2.0
2.5
3.0
3.5
4.0
(400°C)
(425°C)
(450°C)
(500°C)
(375 °C)
(375°C)
(450°C)
(400°C)
(425°C)
(350°C)
(350°C)
(500°C)

SHALE-OIL RECOVERY PROCESS

BACKGROUND OF THE INVENTION

The present invention relates to a relatively mild thermal-extraction process for converting the organic material of oil-shale to predominantly liquids. The oil-shale is first heated to a temperature from about 360° C. to 475° C. in an inert atmosphere. The resulting liquids and gases are collected and the residue is extracted with a microemulsion to recover additional amounts of liquids.

Oil-shale, one of the leading sources under investigation for the production of synthetic fuels, may play a leading role in the energy future of the United States. The primary reason for the growing importance of oil-shale, as well as coal, is the rapid depletion of known petroleum and natural gas reserves. These known reserves are being depleted at a faster rate than the rate of discovering new reserves. As the era of petroleum growth draws to a close, the worlds energy mix will have to change. Transition energy sources will be needed as a bridge between petroleum and the potentially unlimited energy sources of the future; such sources being, for example, solar power and nuclear fusion. Owing to their great abundance, coal and oil-shale are perceived as the keystones of such a bridge. Consequently, a great deal of research and development is presently in progress to provide economical ways of converting these solid resources to valuable liquids and gases.

Generally, oil is produced from oil-shale by heating the oil-shale in either a fixed or moving bed reactor at a temperature from about 500° to 550° C. for a long enough time to convert the organic matter to gas, oil, and coke. The volatile conversion products are then conventionally distilled from the inorganic residue, or spent shale. Another technique known in the art for obtaining oil from oil-shale is the heating of oil-shale at elevated temperatures, either alone or in the presence of solvent, followed by extracting the soluble conversion products with an extracting agent. The extraction is an alternative to distillation.

An example of a low temperature process which is conventionally used for producing liquids from oil-shale is the process described in a paper entitled *Controlled Low-Temperature Pyrolysis of Benzene-Extracted Green River Oil-Shale* by J. J. Cummins and W. E. Robinson from "Preprints of the American Chemical Society Division of Fuel Chemistry", Vol. 12, pp. 41–50, 1968. Such a low temperature process comprises heating the oil-shale in a helium atmosphere at atmospheric pressure, at a temperature from 300° C. to 350° C., for a period of time ranging from 12 to 96 hours.

Another process disclosed in the art is the process described in "Bureau of Mines Report of Investigations 4744", November 1950, entitled *A Thermal Decomposition Study of Colorado Oil-Shale* by A. B. Hubbard and W. E. Robinson. According to this Bureau of Mines Report, a two step process is not necessary because they believe that heating the oil-shale for an extended period of time in only one step results in the same conversions as if the oil-shale was first heated for a shorter period of time followed by extraction with an extracting agent. This is contrary to the teaching of the present invention.

Still another process taught in the art is the process taught in U.K. Pat. No. 291,475 (1928) which teaches that oil-shale first undergoes preliminary heating at a temperature from 300° C. to 305° C. for 100 to 120 minutes, followed by heating the material further to a temperature of 400° C. to 600° C., then followed by extracting the oil with an entraining agent which may be an oil fraction from the oil-shale. It will be shown by the examples to follow that subjecting the oil-shale to a relatively low-temperature preheat is detrimental for obtaining optimum yields of liquid product.

Even though myriad processes for obtaining oil from oil-shale are disclosed in literally thousands of publications and patents published over the last hundred years, there still exists a need in the art for a better scientific understanding of oil-shale as well as processes which would make the commercialization of oil from oil-shale more economical.

SUMMARY OF THE INVENTION

In accordance with the present invention, there is provided a process for obtaining high conversions of organic material in oil-shale to predominantly liquid products. The process comprises: (a) heating the oil-shale to a temperature from about 360° C. to about 475° C. in an inert atmosphere while simultaneously collecting the resulting volatiles; (b) maintaining the oil-shale within such temperature range for an effective period of time; (c) cooling the remaining solid residue to a temperature below the boiling temperature of water at the pressure employed; and (d) extracting the residue with a microemulsion or coarse emulsion capable of solubilizing the organic material of the residue at such temperatures.

The microemulsion is comprised of: (i) about 0.3 to about 98 wt.% of an extracting agent capable of extracting organic material from the heat treated oil-shale; (ii) about 1 to about 99 wt.% of water containing up to about 25 wt.% of dissolved inorganic salts; and (iii) about 0.2 to about 20 wt.% of at least one surfactant capable of forming microemulsion.

In preferred embodiments of the present invention, the oil-shale is heated at a temperature from about 400° C. to about 450° C., the inert atmosphere is nitrogen, and the extracting agent of the microemulsion is a low boiling point cut of the liquid product stream obtained herein.

In another preferred embodiment of the present invention the surfactant of the microemulsion is an anionic surfactant such as a sulfonate.

BRIEF DESCRIPTION OF THE FIGURE

The sole FIGURE shows plots of conversion of organic material to liquids and gases versus time for Green River oil-shale processed both within the limitation of the present invention as well as outside the limitations of the present invention.

DETAILED DESCRIPTION OF THE INVENTION

The general composition and characteristics of oil-shale are well-known and will therefore not be described in detail herein. For practical purposes, the oil-shale should contain at least 10, preferably at least about 20, and more preferably between about 25 and 75 gallons of oil per ton of oil-shale, by Fischer Assay.

Although the present invention can be practiced on any type of oil-shale, it is more advantageous to employ an oil-shale having a relatively high hydrogen to carbon atomic ratio (H/C). Non-limiting examples of such oil-shales include Rundle oil-shale from Australia, having an H/C of about 1.57, and Green River oil-shale from Colorado, having an H/C of about 1.55. Devonian oil-shale, which has an H/C of 1.11, can also be treated in accordance with the present invention.

Any type reactor may be employed in the practice of the present invention as long as it is capable of achieving solids residence times of about 1 to about 270 minutes and is capable of withstanding temperatures of about 360° C. to about 475° C.

Although the particle size of the oil-shale is not critical, it is preferred for convenience of handling that the oil-shale be crushed to a particle size having an average diameter of less than about 1 inch; preferably less than about ½ an inch. The diameter of the particles as referred to herein is the smallest size of the screen opening through which particles of the designated "diameter" will pass.

The crushed oil-shale is fed to the reaction vessel and heated to a temperature of about 360° C. to about 475° C., preferably about 400° C. to about 450° C., more preferably about 425° C. to about 450° C., at an effective solids residence time. By effective solids residence time, as sometimes referred to herein as an effective period of time, we mean the amount of time required to achieve at least 80% of the conversion level achievable by the practice of the present invention for any given oil-shale at any given temperature from 360° C. to 475° C. That is, if the oil-shale is heated for too short, or too long, a period of time, relatively low yields of extracted product are obtained. Although not wishing to be limited by theory, it is believed that depolymerization of the organic material is not complete enough for the shorter periods of times and that polymerization reactions are too extensive for the longer periods of times. If polymerization reactions are allowed to proceed to an undesirable degree, insoluble refractory type material is obtained. Consequently, there exists a limited temperature range in which there is an advantageous balance of depolymerization and polymerization wherein maximum yields are obtained during extraction. The precise range will be dependent on such things as the particle oil-shale, temperature, and pressure employed and can easily be determined by one having ordinary skill in the art by the teaching of this invention and with a limited amount of routine experimentation.

The FIGURE herein illustrates the need for an effective solids residence time by showing the effect of solids residence times at various reaction temperatures. In fact, it is this concept of a limited window of solids residences times, at a given temperature, which helps to differentiate the present invention from the prior art and which allows one to obtain relatively high conversions of the organic material of oil-shale under relatively mild conditions. This temperature window is about 360° C. to 450° C. Generally, the residence times are between about 1 minute and 270 minutes, depending on the specific temperature employed.

During thermal treatment of the oil-shale, various volatiles will evolve. These volatiles are collected and materials which are normally liquid at room temperature and atmospheric pressure are condensed-out in a separate unit. A cut of the resulting liquid may then be used as the extracting agent for the microemulsion. Although the process of the present invention may be conducted as either a batch or a continuous process, a continuous process is preferred.

After thermal treatment, the resulting solid residue is cooled to a temperature below the effective boiling temperature of the aqueous phase employed in the subsequent extraction step. The term, effective boiling temperature, as used herein, means the maximum boiling temperature of the aqueous phase of the microemulsion at any given pressure. The solid residue is then treated with a microemulsion containing one or more extracting agents to extract-out an additional amount of organic liquids. The term extracting agent, as used herein, means those reagents which are capable of solubilizing, or volatilizing, the organic material of the solid residue at temperatures from about room temperature (20° C.) to about 350° C., preferably about 50° C. to about 300° C., more preferably about 50° C. to about 200° C.

The extracting agents are used as the oil ingredient of the microemulsion employed in the practice of the present invention. Non-limiting examples of extracting agents, or microemulsion oils, which may be used in the practice of the present invention include: refined crude oil; synthetic oil, or boiling fraction thereof e.g., a sweet or sour crude; synthetic crude, such as shale-oil; refined fraction such as kerosene, diesel oil, lube oil, aromatic naphtha, or white oil boiling at from 80° to 345° C.; $C_6$ to $C_{22}$ aliphatic hydrocarbon or aromatic hydrocarbon boiling at from 80° to 300° C. or mixtures thereof. Also included are BTX streams or components thereof, a low boiling point cut (20° C. to 200° C.) of the liquids produced in accordance with the present invention as well as solvents such as tetrahydrofuran (THF), tetralin, toluene, cyclohexane, and octane, and mixtures thereof. Preferred is a low boiling point cut of the liquids produced by the practice of the present invention. By BTX streams, we mean streams comprised essentially of benzene, toluene, and xylene. The amount of oil employed can vary over wide ranges of from 0.3 to 98% by weight, based on the microemulsion.

Although most of the extractions of the examples to follow were performed by a Soxhlet technique, it will be understood that when very large quantities of oil-shale are to be converted, extraction techniques such as hot gravity filtration would be more desirable from both an economical, as well as a yield point of view.

Although it is preferred to practice the present invention at atmospheric pressure, it may also be practiced at subatmospheric pressure or above atmospheric pressure to facilitate separations with the use of various microemulsions. An inert atmosphere is employed throughout the practice of the present invention especially during the thermal and extraction steps. Preferably the inert atmosphere is comprised of substantially nitrogen.

In order to form a microemulsion, a surfactant or mixture of surfactants must be present in at least an amount effective to form micelles. The amounts of surfactants employed are generally from 0.2 to 20%, preferably 0.2 to 15%, more preferably from 0.2 to 10%, and most preferably from 0.5 to 8% by weight, based on the microemulsion. Co-surfactants may be present in amounts of from 0 to 15 wt.%, preferably 0.2 to 10 wt.%. Larger amounts are possible but are not usually feasible from an economic standpoint.

Surfactants suitable for use in the microemulsions herein may be anionic, cationic, nonionic, amphoteric, or mixtures thereof. The choice of the surfactant system is generally predicated upon conditions within the oil-shale deposit. For example, if high salinities are present, combinations of anionic surfactant with cationic or nonionic co-surfactants may be desirable. Regardless of the particular surfactant system used, the ratio of co-surfactant to anionic surfactant must be adjusted or balanced to accomodate the desired salinity and temperature ranges and achieve high oil uptake in the microemulsion and low interfacial tensions vs. oil.

Anionic surfactants and co-surfactants include sulfonates, sulfates, carboxylates, and phosphates which may be present in the acid or salt form. Sulfonates and sulfates are preferred.

Anionic sulfonates may have the formula $$[R^1—SO_3]^-Y^+$$

wherein $R^1$ is $C_8$ to $C_{25}$ aliphatic, $C_{14}$ to $C_{36}$ alkylaryl or $R^2—(OCH_2CH_2)_n$ where $R^2$ has the same definition as $R^1$ and n is an integer from 1 to 60, and Y is hydrogen or a monovalent cation such as alkali metal or $N(R^3)^+_4$ where each $R^3$ is independently hydrogen, alkyl or hydroxy substituted alkyl, each of 1 to 4 carbon atoms. Preferred alkylaryl include alkylphenyl, alkyltolyl and alkylxylyl having from 8 to 26 carbons in the alkyl. Especially preferred are alkylbenzene and alkylxylene sulfonates wherein the alkyl group contains from 8 to 18 carbon atoms. Sulfonated ethoxylated $C_8$ to $C_{26}$ alkylphenols and sulfonated ethoxylated dinonyl phenols containing from 8 to 50 $—CH_2CH_2O—$ groups are preferred anionic co-surfactants. The aliphatic chain in $R^1$ may be interrupted by ester or amide linkages. Anionic surfactants may also be petroleum sulfonates which are derived from the treatment of petroleum oils with strong sulfuric acid.

The anionic sulfate surfactants have the formula $$[R^4—OSO_3]^-Y^+$$

Where $R^4$ is $C_8$ to $C_{25}$ aliphatic, $C_{14}$ to $C_{38}$ alkylaryl or $R^5—(OCH_2CH_2)_n$ where $R^5$ has the same definition as $R^4$ and n is an integer from 1 to 60, and Y is hydrogen, alkali metal cation or $N(R^3)^+_4$, where each $R^3$ is independently hydrogen, alkyl of 1 to 4 carbon atoms or hydroxyalkyl of 1 to 4 carbon atoms. The aliphatic chain in $R^4$ may be interrupted by $$—\overset{O}{\overset{\|}{C}}—NH,\ —\overset{O}{\overset{\|}{C}}—O—\ \text{or}\ —OCH_2CH_2—$$

linkages. Examples include sulfated alkanols or sulfated ethoxylated alkanols, especially sulfated ethoxylated $C_{12}$–$C_{16}$ alkanols.

Also suitable as anionic surfactants are $C_8$ to $C_{30}$ aliphatic carboxylates wherein the aliphatic chain may be interrupted by amido linkages, and aromatic carboxylates such as $C_8$ to $C_{36}$ alkyl substituted benzoic acids. Carboxylates derived from fatty acids are preferred. Other anionics include esters derived from the oxy acids of phosphoric acid such as phosphoric acid, ortho- and polyphosphoric acids. The esters are derived from $C_6$ to $C_{24}$ alkanols and alkylphenols wherein the ester linkage or alkyl chain may be interrupted by ethoxy or amido groups.

Anionic surfactants may also have the formula $$R_aO(C_3H_6O)_m(C_2H_4O)_nYX$$

where $R_a$ is a $C_8$ to $C_{30}$ aliphatic radical or benzene substituted by $C_6$ to $C_{24}$ alkyl or alkenyl, m and n are at least 1 and preferably have average values between about 1 and 10, respectively; Y is sulfate, sulfonate, carboxylate or phosphate and X is a cation. These surfactants are further described in European Patent Application, Publication No. 0003183 A-1 which is incorporated herein by reference.

Nonionic surfactants are ethoxylated derivatives of phenols, amines, carboxylic acids, alcohols and mercaptans, as well as polyhydroxy compounds. The ethoxylated phenols may have the formula $$(R^6)_r—A—[O(CH_2CH_2O)_p]_qH$$

wherein $R^6$ is $C_1$ to $C_{24}$ alkyl, A is benzene, naphthalene or diphenyl, p is 2 to 60, q is 1 or 2 and r is 1 to 5 with the proviso that when r is 1, $R^6$ is at least $C_8$. Preferred nonionic surfactants are ethoxylated $C_8$–$C_{24}$ alkylphenols, ethoxylated octyl, nonyl or dodecyl phenols containing 8 to 24 $—CH_2CH_2O—$ groups, or ethoxylated dinonyl phenols containing 8 to 50 $—CH_2CH_2O—$ groups.

Ethoxylated amines may be cationic or nonionic depending on the degree of ethoxylation. Higher degrees of ethoxylation render fatty amines nonionic in character. Preferred amines are $C_8$ to $C_{30}$ alkyl amines, $C_8$ to $C_{30}$ ethoxylated amines or quaternary ammonium salts thereof. Ethoxylated amines of the formula $$R^7—N\begin{matrix}(CH_2CH_2O)_xH\\(CH_2CH_2O)_yH\end{matrix}$$

where $R^7$ is a $C_8$ to $C_{30}$ aliphatic radical and the sum of x+y is from 2 to 30 are preferred.

Aliphatic carboxylic acids of from 8 to 30 carbon atoms can be esterified with ethylene oxide to form nonionic surfactants. The degree of ethoxylation may be from 2 to 30. Also, $C_8$ to $C_{25}$ alkanols and mercaptans can be converted to polyethoxy ethers and thio-ethers by reaction with ethylene oxide.

Examples of nonionic surfactants which are not polyethoxylated are esters of sugar alcohols, sorbitol and mannitol. The acid moiety of the ester is generally a fatty acid. Other fatty acid derivatives include esters of di- and poly saccharides and condensates of fatty acids with alkanolamines.

Suitable cationic surfactants are amines, polyamines and quaternary ammonium salts. The amines are higher aliphatic amines of from 8 to 30 carbon atoms and may be primary, secondary, or tertiary. Examples of higher aliphatic amines are straight and branched chain alkyl amines, fatty amines and rosin amines. The aliphatic chain may be interrupted by one or more ester, ether, or amido linkages. Also suitable are heterocyclic 5 or 6 membered ring systems containing nitrogen and optionally oxygen as hetero atoms and bearing an alkyl group of 8 to 20 carbon atoms. Examples of heterocyclic rings are imidazole, pyrimidine, oxazoline, piperazine and guanadine. The amines may also be di- or triamines derived from fatty amines. Examples of diamines derived from fatty amines are sold under tradename Duomeens by Armak Co.

Preferred cationics are derived from the ethoxylation of higher aliphatic primary or secondary amines with ethylene oxide wherein the degree of ethoxylation is from 2 to 30. Particularly preferred are ehtoxylated amines of the formula:

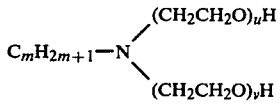

where m is from 8 to 25 and the sum of u+v is from 2 to 20. This type of amine is manufactured by the Armak Co. and sold under the tradename Ethomeen.

Another preferred class of cationic surfactants are quaternary ammonium salts. The quaternary salts are usually derived from tertiary amines by reaction with alkyl halides or sulfates. The tertiary amines are those described above, e.g., higher aliphatic, heterocyclic and ethoxylated higher aliphatic.

Amphoteric surfactants usually contain an amino moiety as the basic function and a carboxylic or sulfonic acid as the acidic function. Examples of aminocarboxylic acids are $R^8NHR^9COOH$ where $R^8$ is $C_8$ to $C_{20}$ aliphatic and $R^9$ is $C_1$ to $C_8$ alkyl, $[(R^{10})_3N—(CH_2)_{1-5}COO^-]$ where $R^{10}$ is $C_1$ to $C_{22}$ aliphatic, condensation products of ethylendiaminetetraacetic acid and fatty acids, and N-alkyl derivatives of aspartic acid. Examples of amino-sulfonic acids are

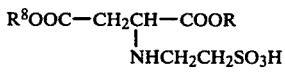

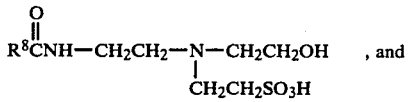

, and

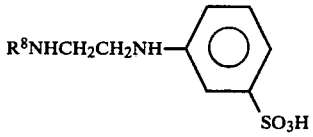

, $R^8$ and $R^9$ being defined as above. Imidazole derivatives form another class of amphoterics, i.e.,

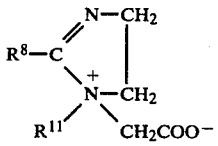

where $R^{11}$ is $C_1$ to $C_8$ alkyl, $C_2H_4OH$ or $C_2H_4NH_2$.

If the anionic surfactants are used in combination with anionic, nonionic, or cationic co-surfactants, then a preferred surfactant combination contains alkyl or alkylaryl sulfonates or sulfates as the anionic component and ethoxylated aliphatic amines as the cationic or nonionic component. Other preferred combinations include alkylaryl sulfonates with ethoxylated or sulfated ethoxylated alkanols or alkyl phenols. Especially preferred are alkyl xylene sulfonates with $C_{18}$ ethoxylated amines containing 5–15 EO (—$CH_2CH_2O$—) groups and alkyl xylene sulfonates with ethoxylated or sulfonated ethoxylated di-nonyl phenols containing 8 to 50 EO units. Examples of preferred combinations are i-dodecyl-o-xylene sulfonic acid or sodium salt thereof with ethoxylated octadecyl amine having from 2–15 EO groups and the sodium, ammonium, monoethanolamino, diethanolamino, and triethanolamino salts of i-dodecyl-o-xylene sulfonic acid with ethoxylated, sulfated ethoxylated and sulfonated ethoxylated octyl phenol, -nonyl phenol, -dinonyl phenyl, -dodecyl phenol, and -tridecanol, wherein the number of EO groups ranges from 4 to 50.

The surfactant component of the present microemulsions can be prepared by conventional methods well-known in the art. An extensive review of processes for synthesizing and manufacturing surfactants can be found in "Surface Active Agents and Detergents," Vol. II, Part I by Schwartz et al (Interscience Publishers, 1958), which is incorporated herein by reference.

The microemulsions of the present invention are also prepared by well-known techniques. Generally, an oil, water or brine and an amount in excess of the critical micelle concentration of a surfactant and a co-surfactant are combined. The ratio of surfactant to co-surfactant is balanced for the desired salinity and temperature. The surfactant and co-surfactant are chosen to maximize the solubilization of the given oil at the desired salinity. Generally, higher salinity requires a more hydrophilic co-surfactant.

The surfactant is chosen from a group having an optimal salinity less than the desired salinity whereas the co-surfactant is chosen from a group having an optimal salinity greater than the desired salinity. The optimal salinity of a surfactant is defined as that salinity at which water and oil uptake are equal in a microemulsion containing the specified oil at the specified temperature. The ratio of surfactant to co-surfactant is adjusted to accomodate the desired salinity, temperature, oil composition, surfactant composition, and oil:water ratio such that the system is a single transparent or translucent phase which is stable to gravity settling. Under some conditions, the resulting microemulsion may be a "birefringent microemulsion", i.e., it may exhibit anisotropy and birefringence which are characteristics of liquid crystals.

From 0 to 15% by weight of co-solvents and one or more co-surfactants may optionally be incorporated into the microemulsions to assist in microemulsion formulation. Preferred co-surfactants and/or co-solvents include alcohols, ethoxylated-, sulfated ehoxylated- and sulfonated ethoxylated alcohols, all of which are $C_3$ to $C_{20}$ in the aliphatic chain as well as ethoxylated, sulfated ethoxylated- and sulfonated ethoxylated phenols.

The following examples serve to more fully describe the manner of practicing the above-described invention, as well as to set forth the best modes contemplated for carrying out various aspects of the invention. It is to be understood that these examples in no way serve to limit the true scope of this invention, but rather, are presented for illustrative purposes.

Heat Treatment Experiments

Examples 1–12 and Comparative Examples A–G demonstrate that the oil-shale must be heat treated in accordance with the present invention in order for a substantial portion of the shale-oil to be extractable with extracting agents employed herein.

Experimental Apparatus For Heat Treatment Examples

Thermal treatment was performed in a pyrolysis unit comprised of a lower reactor section and an upper condenser section. The reactor section consisted of a tared quartz tube closed at the bottom and the condenser consisted of a tared Pyrex tube packed with tared 3 mm Pyrex beads supported on a stainless steel screen.

Quartz wool was packed in the bottom of the condenser and glass wool was packed at the top. A narrow stainless steel tube extended through the condenser and halfway into the reaction tube to allow the introduction of nitrogen gas into the reaction tube to facilitate the sweep-out of primary pyrolysis products.

Dry ice was used to cool the condenser section and a stainless steel heating block was used during the thermal treatment step. The stainless steel block contained a cavity bored partially therethrough so that the pyrolysis unit could be placed therein in such a way that the reaction tube was incased in the block. The cavity was partially filled with gallium (mp 29.8° C., bp 2403° C.) to facilitate rapid heatup (about one min.).

Thermal Treatment Step

About two grams of oil-shale was placed in the reaction tube. A nitrogen purge of 40 cc/min. was provided and dry ice was packed around the condenser section. After cooling for about 5 minutes, the unit was placed in the heating block at a preselected temperature from about 350° C. to 500° C. for a preselected period of time. The entire unit, with dry ice and nitrogen purge maintained, was removed from the heating block and allowed to cool to room temperature (about 25° C.). The dry ice and nitrogen purge was removed, but the liquid reaction product on the condenser beads and the non-volatilized residue were maintained under a nitrogen atmosphere. The pyrolysis unit was then weighed to obtain conversion to gases. The unit was then separated and the condenser section was placed in a nitrogen-purged dry box. The pyrex beads, quartz wool, and condenser walls were washed with methylene chloride which was subsequently evaporated in a tared flask under a stream of nitrogen and weighed to obtain conversion of oil-shale to shale oil product.

Extraction Step

The reaction tube containing the remaining solids was weighed and transferred to a tared Soxhlet thimble, which was then weighed and Soxhlet extracted for about 48 hrs., under a nitrogen atmosphere, with tetrahydrofuran (THF) (bp 67° C.) which had been distilled from sodium-benzophenone to assure purity and dryness. After extraction, the solid residue was dried overnight in a vacuum oven at about 100° C. and weighed. The THF solution was rotovaporated at 55°–60° C. and the liquid products were weighed to obtain the degree of conversion to shale oil.

EXAMPLES 1–8 AND COMPARATIVE EXAMPLES A AND B

Samples of Green River, Rundle, and Devonian oil-shale were thermally treated and extracted by following the general procedure set forth above except that each sample differed with respect to the temperature and the duration at which the sample was thermally treated. Tables I, II, and III below show the percent of organic conversion for Green River, Rundle, and Devonian oil-shale respectively. The hydrogen to carbon atomic ratio for the oil-shales were 1.55 for Green River, 1.57 for Rundle, and 1.11 for Devonian.

TABLE I

Conversion of Green River Oil-Shale

| Example (Temp. °C.) | Time Thermal Step | Conversion of Organic Material (Wt. %) Thermal Step | Extraction Step | Total |
|---|---|---|---|---|
| Comp. A (350° C.) | 1 hr | 8.59 | 19.23 | 27.82 |
| | 1.5 | 10.80 | 16.52 | 27.32 |
| | 2 | 14.35 | 27.15 | 41.50 |
| | 3 | 16.05 | 16.46 | 32.51 |
| Ex. 1 (375° C.) | 1 hr | 16.07 | 32.13 | 48.20 |
| | 2 | 23.48 | 34.16 | 58.09 |
| | 3 | 30.90 | 61.80 | 92.70 |
| | 4 | 28.43 | 39.55 | 67.98 |
| Ex. 2 (400° C.) | 0.75 hr | 36.40 | 59.78 | 96.22 |
| | 1.25 | 53.54 | 38.39 | 91.93 |
| | 1.5 | 43.63 | 50.25 | 93.88 |
| | 2 | 52.56 | 36.73 | 89.29 |
| | 3 | 55.26 | 14.86 | 70.12 |
| Ex. 3 (425° C.) | 0.25 hr | 41.19 | 42.91 | 84.10 |
| | 0.5 | 46.57 | 44.22 | 90.79 |
| | 1 | 57.31 | 14.48 | 71.79 |
| | 1.5 | 58.45 | 9.34 | 67.79 |
| Ex. 4 (450° C.) | 0.17 hr | 33.50 | 53.86 | 87.36 |
| | 0.25 | 55.19 | 33.68 | 88.87 |
| | 0.50 | 76.71 | 9.73 | 86.44 |
| | 0.75 | 58.10 | 12.10 | 70.20 |
| Ex. 5 (475° C.) | 5 min. | 32.90 | 67.74 | 99.83 |
| | 10 min. | 50.02 | 21.14 | 76.16 |
| | 15 min. | 56.77 | 9.14 | 65.91 |
| | 20 min. | 60.87 | 9.45 | 70.32 |
| Comp. B (500° C.) | 5 min. | 57.63 | 11.90 | 69.53 |
| | 10 min. | 62.12 | 7.90 | 70.02 |
| | 15 min. | 60.90 | 3.66 | 64.56 |

TABLE II

Conversion of Rundle Oil-Shale

| Example (Temp. °C.) | Time Thermal Step | Conversion of Organic Material (Wt. %) Thermal Step | Extraction Step | Total |
|---|---|---|---|---|
| Ex. 6 (400° C.) | 1 hr | 18.85 | 31.80 | 50.65 |
| | 1.5 | 25.82 | 38.05 | 63.87 |
| | 2 | 25.83 | 21.74 | 47.57 |
| Ex. 7 (425° C.) | 0.75 hr | 24.73 | 21.20 | 45.93 |
| | 1 | 45.93 | 40.05 | 85.98 |
| | 1.5 | 36.03 | 38.80 | 74.83 |
| | 2 | 49.62 | 15.04 | 64.66 |

TABLE III

Conversion of Devonian Oil-Shale

| Example (Temp. °C.) | Time Thermal Step | Conversion of Organic Material (Wt. %) Thermal Step | Extraction Step | Total |
|---|---|---|---|---|
| Ex. 8 (425° C.) | 1 hr | 26.09 | 21.74 | 47.83 |
| | 1.5 | 35.12 | 18.39 | 53.51 |
| | 2 | 40.13 | 6.69 | 46.82 |
| | 3 | 40.04 | 10.01 | 50.05 |

The data of Table II above appears in the sole FIGURE hereof in plotted form. It can be seen from the data of the above tables that total conversion of organic material in oil-shale, to liquids, decreases as the duration of thermal treatment increases. Although not wanting to be limited by theory, it is believed that this occurs because unfavorable thermal condensation reactions of the non-volatile conversion products is taking place. It can also be seen by the data in these Tables that an optimum time and temperature range exists for obtaining maximum conversion.

The solid symbols connected by the straight line in the FIGURE hereof indicate the amount of material which is extractable at the maximum conversion point at each temperature. The data of these tables is contrary to the teaching of Hubbard and Robinson which reinforces the general belief that the extraction step is unnecessary because it was thought that comparable conversions could be obtained by prolonged heating only. The data also show that temperature extremes are unsuitable; i.e., 350° C. is too low a temperature and 500° C. is too high a temperature for obtaining relatively high organic conversions by the instant invention.

Furthermore, the data show that at the residence times required for peak conversions, a significant portion of the liquid product is recovered by extraction. Consequently, in order to obtain maximum recovery of the organic material, there must be a compromise between recovery of volatile products, recovery of extractable products, and loss of potentially valuable liquid products to coke.

EXAMPLES 9, 10 AND COMPARATIVE EXAMPLES C TO E

Samples of Green River and Rundle oil-shale were thermally treated for 1 hour at 400° C. and extracted in accordance with the aforementioned general procedure except the samples designated as comparative examples were subjected to distillation at 500° C. immediately after thermal treatment. All samples were extracted for 48 hours with THF by Soxhlet extraction according to the general procedure. Comparative examples C and E were distilled for 10 minutes. Table IV below sets forth the weight percent conversion of organics achieved for each example.

TABLE IV

Conversion to Liquid/Efficiencies of Distillation vs. Extraction After Thermal Treatment of Oil-Shale

| Example | Thermal °C. | Time | Distillation °C. | Time | Wt. % Conversion w/o Extraction | Wt. % Conversion with Extraction |
|---|---|---|---|---|---|---|
| Comp. C (GR) | 400 | 1 | 500 | 15 | 63.0 | 73.5 |
| Comp. D (GR) | — | — | 500 | 10 | 62.1 | 70.0 |
| 9 (GR) | 400 | 1 | — | — | 43.3 | 94.4 |
| Comp. E (R) | 400 | 1 | 500 | 15 | 66.9 | 79.4 |
| 10 (R) | 400 | 1 | — | — | 39.8 | 89.9 |

GR = Green River oil-shale
R = Rundle oil-shale

The data of Table IV illustrate that the organic material of the oil-shale which is depolymerized during the thermal treatment cannot be recovered by subsequent distillation at conventional retorting temperatures, but can be extracted as liquids with a solvent such as THF. The data also show that approximately 50% more organic liquids can be extracted after a relatively mild thermal treatment, whereas distillation is capable of recovering only about 10% more liquids from the oil-shale after the mild thermal treatment. This data indicate that conventional retorting temperatures result in decreased conversion of oil-shale to organic liquids because detrimental side reactions occur more rapidly then distillation at these temperatures.

EXAMPLE 11

A sample Green River oil-shale was thermally treated at 400° C. for 1 hour in accordance with the general procedure. The resulting residue produced 40 wt.% of thermal products and 44 wt.% of extractable liquids. The remaining residue was reheated at 400° C. for 1 hour and extracted as described in the general procedure; the remainder of the organic material was recovered. This example demonstrates that the resulting solid residue is not an unconverted residue, but is in fact material which is incompletely converted. The mild thermal treatment of the process of the present invention does not cause substantial degradation of the organic material in oil-shale. Degradation would lead to intractable coke materials via condensation reactions as evidenced in Table IV above.

EXAMPLE 12 AND COMPARATIVE EXAMPLES F AND G

Three samples of Green River oil-shale were treated in accordance with the general procedure hereof except air and carbon dioxide were used, instead of nitrogen, during the thermal treatment step (400° C. for 2 hours) for two of the samples. Table V below sets forth the conversion data for these samples after the extraction step.

TABLE V

Effect of Atmosphere During Thermal Step

| Example | Atmosphere | Conversion of Organics to Liquids (Wt. %) |
|---|---|---|
| 12 | $N_2$ | 82.5 |
| Comp. F | Air | 76.0 |
| Comp. G | $CO_2$ | 74.6 |

These data show that an inert atmosphere is required during the thermal step in order to achieve high conversions.

MICROEMULSION DATA

Microemulsions (M.E.) exist as one of four types; single phase, two phase M.E.⇄water (upper), two phase M.E.⇄oil (lower) and 3 phase water⇄M.E.⇄oil (middle). The transition upper→middle→lower is called a hydrophilic shift since it progressively involves the absorption of water and rejection of oil. A hydrophilic shift results from increasing hydrophile/lipophile (H/L) ratio in the surfactant, increasing alkane carbon number of the oil, increasing temperature (for sulfonate surfactants) and decreasing salinity in the water. The reverse transition, lower→middle→upper is called a lipophilic shift and involves the absorption of oil and rejection of water.

During a hydrophilic shift, the microemulsion phase takes up more water and rejects more oil. When the amount of water and oil taken up into the microemulsion are equal, the microemulsion is a balanced, or middle phase microemulsion. At this point the oil and water uptake are equal. The larger the middle phase volume for a given amount of surfactant, the greater the oil and water uptake at balance. Oil and water uptake at balance depend on surfactant type as well as H/L ratio, salinity, alkane carbon number and temperature.

The middle phase volume also depends on the amount of surfactant. If the surfactant concentration is increased sufficiently, the excess oil and water phases are completely absorbed and the system becomes single phase. This microemulsion is very sensitive to small temperature changes.

Preparation of the Microemulsions

Balanced single phase microemulsions are transparent to translucent homogeneous fluids containing equal volumes of oil and water with the required amount of a suitable surfactant. Using a range of normal alkanes as the oil and 1% NaCl solution as the aqueous phase, a mixture of two sulfonate surfactants were adjusted to yield balanced, homogeneous microemulsions. The surfactants were the mono-ethanol amine salt of branched nonyl o-xylene sulfonic acid ($C_p$* XS-MEA) and octadecyl o-xylene sulfonic acid ($C_{18}$* XS-MEA). The ratio of these two surfactants and the surfactant concentration used to prepare the single phase microemulsions are given in Table VI for selected normal alkanes.
*=branched

TABLE VI

| M.E. Oil | Balanced Single-Phase Sulfonate Microemulsions at 25° C. $C_9$*XS—MEA/$C_{18}$*XS—MEA | Surfactant Concentration |
|---|---|---|
| Hexane | .585/.415 | 4 g/dl |
| Octane | .545/.455 | 5 g/dl |
| Decane | .495/.505 | 6 g/dl |
| Dodecane | .460/.540 | 7 g/dl |
| Tetradecane | .350/.650 | 8 g/dl |

The compositions in this table show certain trends typical of microemulsion behavior. As the alkane carbon number increases from 6 to 14, the $C_9$*XS-MEA/$C_{18}$*XS-MEA ratio, i.e., the H/L ratio, decreases. This reduction in H/L ratio is required to compensate for the hydrophilic shift caused by increasing alkane carbon number of the oil. Thus, to form balanced microemulsions with higher alkanes, we must use more lipophilic surfactants. In addition, higher alkanes also require higher surfactant concentrations to make homogeneous single phase microemulsions. This is because the surfactants have lower oil and water uptakes with larger oil molecules.

Heat Treatment of Oil-Shale

All samples of oil-shale which were used for the following examples were Green River shale pulverized to 100 mesh (U.S. Sieve Size) and heat treated at 400° C. for 1 hour in a nitrogen atmosphere.

EXAMPLES 13–15 and COMPARATIVE EXAMPLES H–J

To evaluate the ability of microemulsions to extract oil from oil-shale, 12 ml of each of the hexane, decane, tetradecane microemulsions described in Table VI above were shaken with 0.6 gm of heat-treated Green River oil-shale. For the comparative examples, the neat oils were used as controls and were also shaken with 0.6 gm of heat-treated Green River oil-shale. In addition, toluene was used as a blank and shaken with 0.6 gm of the heat-treated oil-shale because toluene was found to be a very efficient extractant for the heat-treated oil-shale. All samples were heated to and held at 70° C. for 24 hours during which time they phase separated. The blanks separated into bottom sediment (shale) and amber colored oils except for the toluene which was almost black. The microemulsions separated into bottom sediment (shale) and microemulsion in equilibrium with very dark-colored oil. The amount of oil differed with the alkane carbon number, decane yielding the largest volume which occupied about ⅓ of the tube. The tetradecane microemulsion gave less than 1 ml of oil. This difference probably reflects differences in distance from the temperature—induced phase boundary which depend both on alkane carbon number and surfactant concentration.

The oil phases were spectrophotometrically analyzed relative to the toluene extract as follows: the toluene extract was diluted in stages and the visible spectrum measured. These samples absorbed over the entire visible spectrum, absorbed most strongly near the UV end, and showed no absorption peaks. We, therefore, arbitrarily chose 500 NM to compare samples. Optical densities relative to toluene extract dilutions gave the relative concentrations shown in Table VII below. The alkane blanks had only 8–9% of the shale-oil concentration in toluene while the microemulsion oils had 30% of the toluene extract shale-oil concentration. Thus, the microemulsions excess oil phases were more than 3 times more concentrated than the respective alkane blanks in extracted shale-oil but only ⅓ as concentrated in shale-oil as toluene. Though the shale-oil appears to concentrate strongly in the microemulsion excess oil phase, the actual amount of shale oil recovered in the excess oil is approximately equal to that recovered by the respective blanks. This is because only that ½ the oil originally in the microemulsion separates out as an excess oil phase leaving an undetermined amount of shale-oil in the microemulsion. Note that only the excess oil phase was analyzed spectrophotometrically. The visual color intensity in the residual microemulsion suggests that a significant amount of shale-oil remains with the microemulsion and is not accounted for in the data of Table VII. The fact that the shale-oil is strongly concentrated in the excess alkane phase but not nearly as strongly as in the toluene blank suggests that a microemulsion made with toluene might be even more effective than toluene itself in recovering shale oil.

TABLE VII

MICROEMULSIONS AS SHALE-OIL EXTRACTANTS - OIL PHASE ANALYSIS

| | System | % Shale Oil(1) Rel. to Toluene | Vol. Separated Oil(2) Rel. to Toluene |
|---|---|---|---|
| Ex. 13 | $C_6$ M.E.(3) | 33.1(4) | 0.25 |
| Ex. 14 | $C_{10}$ M.E. | 29.2 | .31 |
| Ex. 15 | $C_{14}$ M.E. | 36.8 | .06 |
| Comp. Ex. H | $C_6$ Oil | 9.3 | — |
| Comp. Ex. I | $C_{10}$ Oil | 8.8 | — |
| Comp. Ex. J | $C_{14}$ Oil | 8.2 | — |

(1)From optical density at 500 NM.
(2)Excess oil phase in equilibrium with microemulsion.
(3)The symbol M.E. denotes microemulsion.
(4)Corrected for hexane evaporative loss = 0.7 ml/6 ml = 11.7%.

EXAMPLES 16–19 AND COMPARATIVE EXAMPLES K–N

Balanced homogeneous (50/50=brine/toluene) microemulsions were prepared using a combination of bilinear sulfonates, dodecyl benzene monoethanol amine sulfonate ($C_{12}$ BS-MEA derived from Conoco Sulfonic acid) and hexadecyl xylene sodium sulfonate ($C_{16}$ XS-Na). Surfactant ratios, concentrations, and brine salinities were adjusted for balance and are given in Table VIII below. A range of concentrations and salinities was used in order to vary the proximity to the concentration and salinity at which phase separation occurs in order to see whether this would affect the extraction efficiency as well as the amount of oil separating on equilibration at elevated temperatures.

TABLE VIII

| Balanced Single Phase Toluene Microemulsions at 25° C. | | |
|---|---|---|
| $C_{12}$ BS—MEA/$C_{16}$ XS—Na | Surfactant Concn. | % NaCl |
| 90/10 (wt. ratio) | 4 g/dl | 1.0 |
| 92/08 | 5 | 1.0 |
| 84/16 | 5 | 0.5 |
| 86/14 | 6 | 0.5 |

Twelve ml. of each of the above microemulsions was shaken with 0.6 gm of heat-treated Green River oil-shale. As a blank, 12 ml. of toluene was prepared in the same way. The experiment was repeated using untreated shale. All the samples and blanks were equilibrated at 70° C. for 24 hrs. Since very little oil separated from the microemulsions, the temperature was raised to 85° C. and the sample re-equilibrated for an additional 24 hrs.

The toluene blank contacting untreated shale separated into bottom sediment and a pale yellow oil. The microemulsions contacting untreated shale separated into bottom sediment and microemulsion in equilibrium with amber colored oil. The darker oil color than the blank indicates that the microemulsion concentrated more shale-oil than the toluene did. This was supported by spectrophotometric analysis. A small absorption peak occured at 390 NM. Optical densities of dilutions of the microemulsion oils compared with the toluene blank yielded the data in Table IX. The microemulsion oils were more than 3 times more concentrated in shale-oil than the toluene blank.

Both the toluene and microemulsions contacting heat-treated shale were intensely black. The microemulsions split out a black oil phase which was spectrophotometrically analyzed at 500 NM. Data are given in Table X. The microemulsion oils were more than 3 times more concentrated in shale-oil than the toluene blank. Since ½ or less of the initial oil in the microemulsion was recovered as an excess oil phase, only part of the extracted shale-oil is represented in the data shown in Tables IX and X. Even so, almost 50% as much shale-oil shows up in the microemulsion excess oil phase as in the toluene blank. (See, for example, the product of % Shale Oil X Vol. Separated Oil for the 90/10 microemulsion in Table X) In addition, the intense black color in the residual microemulsion indicates the presence of more shale-oil than was accounted for in the excess oil phase. If the system were driven to a higher temperature than 85° C. or, preferably, formulated to be more temperature-sensitive, additional shale-oil could be recovered from the residual microemulsion.

TABLE IX

| MICROEMULSIONS AS SHALE OIL EXTRACTANTS: OIL PHASE ANALYSES - UNTREATED SHALE | | | |
|---|---|---|---|
| | Toluene M.E. | % Shale Oil[1] Rel. to Toluene | Vol. Separated Oil Rel. to Toluene |
| Comp. Ex. K | 4% 90/10[2] at 1.0% NaCl | 330 | 0.14 |
| Comp. Ex. L | 5% 92/08 at 1.0% NaCl | 319 | 1.10 |
| Comp. Ex. M | 5% 84/16 at 0.5% NaCl | 330 | 0.06 |
| Comp. Ex. N | 6% 86/14 at 0.5% NaCl | 340 | 0.06 |

[1]From optical density at 390 NM
[2]Wt. ratio of $C_{12}$ BS—MEA/$C_{16}$ XS—Na

TABLE X

| MICROEMULSIONS AS SHALE OIL EXTRACTANTS: OIL PHASE ANALYSES - HEAT TREATED SHALE | | | |
|---|---|---|---|
| | Toluene M.E. | % Shale Oil[1] Rel. to Toluene | Vol. Separated Oil Rel. to Toluene |
| Ex. 16 | 4% 90/10[2] at 1.0% NaCl | 336 | 0.150 |
| Ex. 17 | 5% 92/08 at 1.0% NaCl | 374 | 0.125 |
| Ex. 18 | 5% 84/16 at 0.5% NaCl | 330 | 0.117 |
| Ex. 19 | 6% 86/14 at 0.5% NaCl | 387 | 0.071 |

[1]From optical density at 500 NM
[2]Wt. ratio of $C_2$ BS—MEA/$C_{16}$ XS—Na

What is claimed is:

1. A method for obtaining high conversions of organic material in oil-shale to predominately liquids, which method comprises:

(a) heating the oil-shale to a temperature of about 360° C. to about 475° C. wherein volatiles are simultaneously collected during heating;

(b) maintaining the oil-shale within the temperature range of about 360° C. to about 475° C. for an effective amount of time;

(c) cooling the remaining residue to a temperature below the boiling point of the aqueous phase of the microemulsion of step (d) below;

(d) extracting the remaining residue with a microemulsion, or a coarse emulsion containing a microemulsion, which is capable of extracting the organic material of the residue, wherein the microemulsion is comprised of:

(i) about 0.3 to about 98 wt.% of an extracting agent capable of extracting organic material from the heat treated oil-shale;

(ii) about 1 to about 99 wt.% of water containing up to about 25 wt.% dissolved inorganic salts, and (iii) about 0.2 to about 20 wt.% of at least one surfactant capable of forming a microemulsion; wherein an inert atmosphere is maintained throughout the process.

2. The method of claim 1 wherein component (i) of the microemulsion is a cut, boiling at a temperature from about 20° C. to about 200° C., from an oil-shale liquid, a coal liquid, or a petroleum stream.

3. The method of claim 1 wherein component (iii) of the microemulsion is a mixture of an anionic surfactant with at least one other anionic, nonionic; or cationic cosurfactant.

4. The method of claim 1 wherein component (iii) of the microemulsion is one or more anionic surfactants selected from the group consisting of:

(a) sulfonates represented by the formula $$[R^1—SO_3]^-Y^+$$

wherein $R^1$ is $C_8$ to $C_{25}$ aliphatic, $C_{14}$ to $C_{36}$ alkylaryl or $R^2$—$(OCH_2CH_2)_n$ where $R^2$ has the same definition as $R^1$ and n is an integer from 1 to 60, and Y is hydrogen or a monovalent cation such as alkali metal or $N(R^3)^+_4$ where each $R^3$ is independently hydrogen, alkyl or hydroxy substituted alkyl, each of 1 to 4 carbon atoms;

(b) sulfonates represented by the formula $$[R^4—OSO_3]^-Y^+$$

where $R^4$ is $C_8$ to $C_{25}$ aliphatic, $C_{14}$ to $C_{38}$ alkylaryl or $R^5—(OCH_2CH_2)_n$ where $R^5$ has the same definition as $R^4$ and n is an integer from 1 to 60, and Y is hydrogen, alkali metal cation or $N(R^3)^+_4$, where each $R^3$ is independently hydrogen, alkyl of 1 to 4 carbon atoms or hydroxyalkyl of 1 to 4 carbon atoms; and (c) surfactants represented by the formula $$R_aO(C_3H_6O)_m(C_2H_4O)_nYX$$

where $R_a$ is a $C_8$ to $C_{30}$ aliphatic radical or benzene substituted by $C_6$ to $C_{24}$ alkyl or alkenyl, m and n are at least 1 and preferably have average values between about 1 and 10, respectively; Y is sulfate, sulfonate, carboxylate or phosphate and X is a cation.

5. The method of claim 4 wherein the surfactant is one or more sulfonates in which $R^1$ is a $C_{14}$ to $C_{36}$ alkylaryl group selected from the group consisting of alkylphenyl, alkyltolyl, and alkylxylyl.

6. The method of claim 5 wherein $R^1$ is an alkylbenzene or alkylxylene with the alkyl containing from 8 to 18 carbon atoms.

7. The method of claim 1 wherein component (iii) of the microemulsion is one or more nonionic surfactants which are selected from the ethoxylated derivatives of phenols, amines, carboxylic acids, alcohols, mercaptons, and polyhydroxy compounds.

8. The method of claim 7 wherein the surfactant is one or more ethoxylated phenols represented by the formula $$(R^6)_r—A—[O(CH_2CH_2O)_p]_qH$$

wherein $R^6$ is $C_1$ to $C_{24}$ alkyl, A is benzene, naphthalene or diphenyl, p is 2 to 60, q is 1 or 2 and r is 1 to 5 with the proviso that when r is 1, $R^6$ is at least $C_8$.

9. The method of claim 4 wherein at least one nonionic ethoxylated phenol surfactant is present and is represented by the formula $$(R^6)_r—A—[O(CH_2CHd2^O)p]q^H$$

wherein $R^6$ is $C_1$ to $C_{24}$ alkyl, A is benzene, naphthalene or diphenyl, p is 2 to 60, q is 1 or 2 and r is 1 to 5 with the proviso that when r is 1, $R^6$ is at least $C_8$.

10. The method of claim 4 wherein at least one cationic surfactant is present having the formula

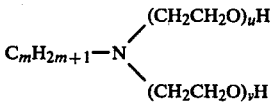

where m is from 8 to 25 and the sum of u+v is from 2 to 20.

11. The method of claim 4 wherein at least one amphoteric surfactant is also present and is comprised of an amino moiety and a carboxylic acid or a sulfonic acid moiety.

12. The method of claim 8 wherein at least one amphoteric surfactant is also present and is comprised of an amino moiety and a carboxylic acid or a sulfonic acid moiety.

13. The method of claim 3 wherein the surfactants employed have hydrophilic and lipophilic properties which are balanced.

14. The method of claim 2 wherein the oil-shale is heated to, and maintained for an effective amount of time at, a temperature of about 400° C. to about 450° C.

15. The method of claim 5 wherein the oil-shale is heated to, and maintained for an effective amount of time at, a temperature of about 400° C. to about 450° C.

* * * * *